US006566809B1

(12) United States Patent
Fuchs et al.

(10) Patent No.: US 6,566,809 B1
(45) Date of Patent: May 20, 2003

(54) RADIATION CONVERTER HAVING AN ELECTRON MULTIPLIER

(75) Inventors: Manfred Fuchs, Nuremberg (DE); Erich Hell, Erlangen (DE); Wolfgang Knuepfer, Erlangen (DE); Detlef Mattern, Erlangen (DE)

(73) Assignee: Siemens Aktiengesellschaft, Münich (DE)

( * ) Notice: Subject to any disclaimer, the term of this patent is extended or adjusted under 35 U.S.C. 154(b) by 145 days.

(21) Appl. No.: 09/655,649

(22) Filed: Sep. 5, 2000

(30) Foreign Application Priority Data

Sep. 8, 1999 (DE) ..... 199 42 940
Mar. 17, 2000 (DE) ..... 100 13 168

(51) Int. Cl.[7] ..... H01J 31/50

(52) U.S. Cl. ..... 313/528; 378/98.8; 250/214 VT

(58) Field of Search ..... 313/523, 527, 313/528, 542, 532, 538, 102 R, 103 CM, 104, 105 CM; 250/214 VT, 207; 378/98.8

(56) References Cited

U.S. PATENT DOCUMENTS 3,710,125 A * 1/1973 Jacobs et al. ..... 250/213 VT
4,691,232 A * 9/1987 Lange ..... 358/111
4,886,970 A 12/1989 Haendle ..... 250/484.1
5,192,861 A * 3/1993 Breskin et al. ..... 250/214 VT
5,374,826 A * 12/1994 LaRue et al. ..... 250/397
5,587,621 A * 12/1996 Colditz ..... 313/366
6,384,519 B1 * 5/2002 Beetz, Jr. et al. .... 313/103 CM

* cited by examiner

*Primary Examiner*—Robert H. Kim
*Assistant Examiner*—Jurie Yun
(74) *Attorney, Agent, or Firm*—Schiff Hardin & Waite

(57) ABSTRACT

A radiation converter includes a radiation absorber for generating light photons dependent on the intensity of incident radiation following the radiation absorber by a photocathode, an electrode system for accelerating the electrons emanating from the photocathode onto an electron detector for generating electrical signals dependent on the incident electrons, and an electron multiplier arranged between the photocathode and the electron detector. The electrons emanating from the photocathode are multiplied by the electron multiplier.

38 Claims, 1 Drawing Sheet

RADIATION CONVERTER HAVING AN ELECTRON MULTIPLIER

BACKGROUND OF THE INVENTION

1. Field of the Invention

The present invention is directed to a radiation converter for converting x-rays into electrical signals, from which a visible image of the x-ray image can be produced.

2. Description of the Prior Art

German OS 33 32 648 discloses a radiation converter which is fashioned as an image intensifier. Such image intensifiers include an input screen having a radiation absorber for generating light photons dependent on the radiation intensity of incoming radiation. The radiation absorber is followed by a photocathode, which generates electrons dependent on the light photons originating from the radiation absorber. These electrons are accelerated by an electrode system onto an electron receiver. In an image intensifier, this electron receiver is fashioned as an output screen that generates light photons due to the incident electrons.

In contrast to a non-destructive material inspection, the radiation load must be kept as low as is technically expedient when a patient is medically examined, so that the radiation load on the patient is as low as possible. To achieve this goal, efficient utilization of the radiation that penetrates the patient and strikes the radiation receiver is of paramount importance. However, the lower the intensity of the radiation incident on the radiation receiver, the lower are the signals that can be derived from the radiation receiver. The amplitude difference between useful signal levels and noise signals also becomes less, which degrades the diagnostic content of the image generated by means of these signals. Therefore, a compromise must be made between a low radiation load for the patient and a radiation dose that is strong enough for allowing a good diagnosis from radiation images of the patient.

Photographic film functions merely as a chemical intensifier, which intensifies the ionization processes of the radiation in the microscopic domain by many dimensions and thus makes the ionizing effects visible in the macroscopic domain.

Storage luminophore plates latently store the radiation shadow image of a subject. On the basis of the latent image, light photons are generated by scanning the storage luminophore plate with a light beam. These light photons are converted into electrons by a readout system with a photomultiplier, whereby the electrons, almost without noise, can be intensified up to a factor of $10^6$ and can be converted into electrical signals. Then, these electrical signals are available for representing the image.

The geometric reduction, which results from a large input window and a small output window, is used with respect to X-ray image intensifiers for intensifying the luminance, guided by the "extra" energy absorbed of the electrons propagating from the input fluorescent screen to the output fluorescent screen through an accelerating field therebetween.

In detectors referred to as flat panel image detectors, a layer which transforms radiation into light and which, for example, contains CsI, is brought in contact with a photodiode matrix composed of amorphous silicon, so that the light photons generated by the layer due to incident radiation can be converted via the photodiode matrix into electrical signals, which then can be utilized for the image representation. Since the light photons are not intensified via the electrons, only relatively weak signals can be obtained from the photodiode matrix, which can only be intensified in a following device, such as an intensifier. Since the charge packets of these relatively weak electrical signals then must also be guided to the intensifier via complicated clocking methods from the large-area flat image detectors via relatively long lines, the average noise, measured in electrons, is almost twice as much as the signal generated by individual X-ray quanta. Particularly for fluoroscopy, wherein only low X-ray doses are applied, the signals that can be obtained from the flat panel image detector are particularly low and are situated close to the noise range and therefore require complicated procedures for artefact correction. In fluoroscopy, the signals of every other scanning ray are inspected (analyzed) for correction purposes, so that the conventional image repetition rates are far from being able to be achieved. The dynamic range of the signals that are obtainable from the flat panel image detector is also considerably restricted.

SUMMARY OF THE INVENTION

An object of the present invention is to provide a radiation converter of the type described above wherein signals, by means of which image signals that still can be appropriately diagnosed can be generated in a following signal processing chain at a display, can be derived at the output of the radiation converter even when the radiation intensity is low.

The object is inventively achieved in a radiation converter having an electron multiplier between an electron detector, which is fashioned as an electron receiver, and the photocathode, the electrons originating from the photo cathode being multiplied via the electron multiplier. Thus, a multiplication of the electrons issuing from the photocathode, and therefore a signal boost of the signals that can be obtained from the electron detector, occur, so that relatively high signals can be obtained at the electron detector even when the intensity of the radiation that is incident on the radiation absorber is relatively low.

It is advantageous to provide a common gas-proof housing for the electrode system, the electron multiplier and the electron detector, so that a compact structure of the radiation converter results. Preferably, the housing contains gas having at least one of the following constituents: argon, krypton, xenon, helium, neon, $CO_2$, $N_2$, hydrocarbon, Di-methyl-ether, methanol-vapor, ethanol vapor. (As used herein, the term "gas" encompasses "gas mixture.") As a result of the admixture of the aforementioned elements and/or compounds, UV light photons are absorbed and do not reach the photocathode, where they would disadvantageously contribute to the generation of electrons.

The radiation absorber particularly transforms radiation into light photons in an advantageous manner when it has a needle-shaped structure and is composed of CsI:Na.

If the intensification of the electrons is to be further increased, it is advantageous to employ a number of electron multipliers each of which can be fashioned as a wire grid, for example. According to a particularly advantageous embodiment, an apertured plastic film that is provided with a metallization on both sides can be provided. Expediently, the plastic film is made of polyimide and the metallization of copper. It is also expedient when the holes of at least two of the electron multipliers are offset relative to one another, so that an increased number of electrons and a beneficial construction of the electron multiplier result, and so that a backscattering of UV-photons onto the photocathode is avoided.

When the photocathode is fashioned of nonconducting or essentially nonconducting material, it is advantageous to provide an electrically conducting intermediate layer between the ray absorber and the photocathode as an electrode, which is preferably composed of gold, so that electrodes can be made available to the photo cathode in this way and so that it is not electrically charged during the operation.

It is particularly advantageous when the electron detector is fashioned as a 2D thin-film panel and is composed of a-Se, a-Si or poly-Si. Such an electron detector has a simple structure and is cost-efficient.

DESCRIPTION OF THE PREFERRED EMBODIMENTS

Figure 1:
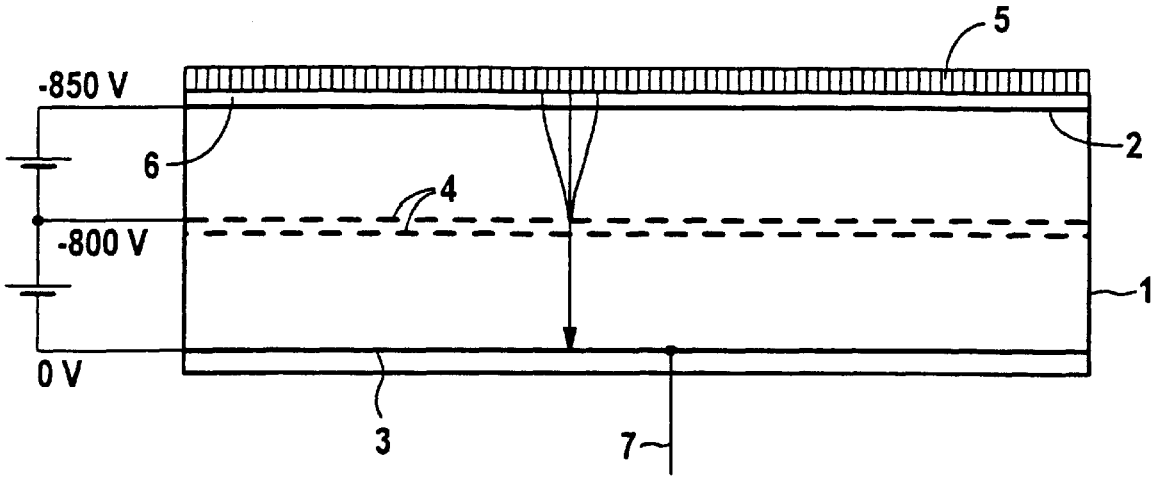
FIG. 1 is a schematic cross-sectional view of a first embodiment from an inventive radiation converter.

In the figures, the inventive radiation converter has a housing 1 containing a photocathode 2 arranged in the region of its front face and having an electron detector 3 arranged in the region of the opposite end face. At least one electron multiplier 4 is provided between the photocathode 2 and the electron detector 3. At least the photocathode 2, the electron multiplier 4 and the electron detector 3 are arranged in the housing 1. A radiation absorber 5, which converts radiation into light photons, can be fashioned as a separate part and arranged outside of the housing in the area of the first face, but is preferably arranged within the housing 1. The radiation absorber 5 is preferably composed of CsI:Na, for example, and has a needle structure, so that the light arising from the radiation absorption can be guided to the photocathode 2 in a directed fashion. An intermediate layer 6 composed of conducting material, which can contain gold or carbon, for example, can be provided between the radiation absorber 5 and the photocathode 2, if the photocathode 2 exhibits only low conductivity. Electrons can be supplied via the intermediate layer 6 to the photocathode 2 in order to prevent charging when the electrons generated by the photocathode 2 are accelerated via an electrical field, which is applied between the photocathode 2 and the electron detector 3, in the direction onto the electron detector 3. Inventively, these electrons can be multiplied by the electron multiplier 4, so that a correspondingly higher signal can be obtained at the electron detector 3. For preventing UV-photons from back-scattering onto the photocathode 2, a gas or gas mixture, particularly a quench gas, such as argon, krypton, xenon, helium, neon, $CO_2$, $N_2$, hydrocarbon, Di-methyl-ether, methanol-vapor, ethanol vapor, is contained in the inside of the housing 1. The quench gas absorbs the UV-photons that are generated during the collision ionization, so that these do not reach the photocathode 2, where they could release electrons in an undesired fashion. In the framework of the invention, the electron multiplier 4 can be fashioned as an aperture plate or a wire grid.

Figure 2:
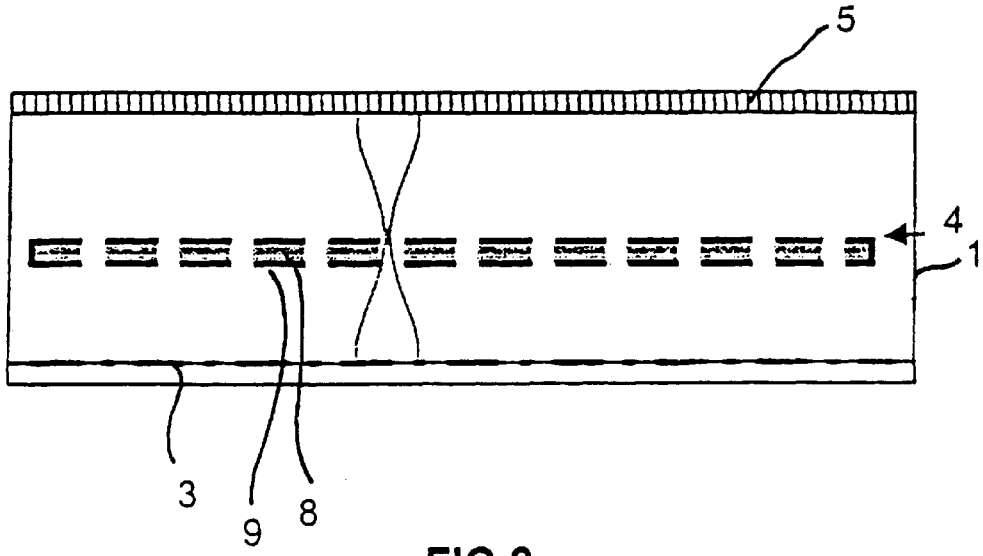
FIG. 2 is a schematic cross-sectional view of a second embodiment of an inventive radiation converter.

It is advantageous when, as shown in FIG. 2, the electron multiplier 4 is composed of a polyimide film 8 that is provided with a copper metallization 9 on both sides. The polyimide film 8 is apertured. The hole diameter preferably is 25 $\mu$m.

Caution must be exercised so that the holes of two electron multipliers 4 are offset to one another if multiple electron multipliers are used, as shown in FIG. 1. This arrangement also serves the purpose of preventing UV-photons from backscattering onto the photocathode 2. Preferably, the electron detector 3 has a pixel structure and converts the incident electrons into electrical signals, which can be tapped via suitable known measures, such as an electrical line 7, and on the basis of which an image representation at a display is possible. For this purpose, the electron detector 3 is preferably fashioned as a 2D thin-film panel and is preferably composed of a-Se, a-Si or poly-Si.

The electrons emanating from the photocathode 2 drift without losses through the holes of the electron multiplier 4 and thereby, in the steeply increasing electrical field, experience an adjustable multiplication, for example, by the factor 100, as a result of the collision ionization, when the potentials at the photocathode 2, the aperture plate fashioned as an electron multiplier 4 and the electron detector 3 are appropriately selected. Such an intensification of the signals is sufficient, particularly with an inventively fashioned solid-state radiation detector, to also conduct medical fluoroscopic examinations with high image frequency. It has proven particularly suitable when the signals of the electron detector 3, by rows, are serially or sub-serially read out.

Although modifications and changes may be suggested by those skilled in the art, it is the intention of the inventors to embody within the patent warranted hereon all changes and modifications as reasonably and properly come within the scope of their contribution to the art.

We claim as our invention:

1. A radiation converter comprising:

a radiation absorber for generating light photon depending on an intensity of radiation incident on said radiation absorber;

a photocathode following said radiation absorber which generates electrons dependent on the light photons generated by said radiation absorber;

an electron detector for generating electrical signals dependent on electrons incident on said electron detector;

an electrode system for accelerating said electrodes from said photocathode onto said electron detector; and an electron multiplier disposed between said photocathode and said electron detector which multiplies said electrons generated by said photocathode, said electron multiplier comprising a plastic film with opposite sides and having apertures proceeding through said plastic film between said opposite sides, said opposite sides each being covered with a metallization.

2. A radiation converter as claimed in claim 1 further comprising a gas-proof housing containing said radiation absorber, said electron multiplier and said electron detector.

3. A radiation converter as claimed in claim 2 further comprising an ultraviolet light suppressing gas contained in said housing.

4. A radiation converter as claimed in claim 3 wherein said gas contains at least one constituent selected from the group consisting of argon, krypton, xenon, helium, neon, $CO_2$, $N_2$, hydrocarbon, Di-methyl-ether, methanol-vapor and ethanol vapor.

5. A radiation converter as claimed in claim 1 wherein said radiation absorber has a needle-shaped structure composed of CsI:Na.

6. A radiation converter as claimed in claim 1 comprising a plurality of electron multipliers disposed between said photocathode and said electron detector for multiplying said electrons generated by said photocathode.

7. A radiation converter as claimed in claim 6 wherein said electron multipliers comprise a plurality of wire grids.

8. A radiation converter as claimed in claim 7 wherein said wire grids have openings therein, and wherein the openings of at least two of said wire grids are offset relative to one another.

9. A radiation converter as claimed in claim 1 wherein said electron multiplier comprises a plastic film with opposite sides and having apertures proceeding through said plastic film between said opposite sides, said opposite sides each being covered with a metallization.

10. A radiation converter as claimed in claim 1 wherein said plastic film is comprised of polyamide and wherein said metallization is copper.

11. A radiation converter as claimed in claim 1 further comprising an electrically conducting intermediate layer forming an electrode of said electrode system, and disposed between said radiation absorber and said photocathode.

12. A radiation converter as claimed in claim 11 wherein said intermediate layer is composed of material selected from the group consisting of gold and carbon.

13. A radiation converter as claimed in claim 1 wherein said electron detector is a 2D thin-film panel.

14. A radiation converter as claimed in claim 13 wherein said 2D thin-film panel has a thin film composed of material selected from the group consisting of a-Se, a-Si and poly-Si.

15. A radiation converter comprising:

a radiation absorber for generating light photon depending on an intensity of radiation incident on said radiation absorber;

a photocathode following said radiation absorber which generates electrons dependent on the light photons generated by said radiation absorber;

an electron detector for generating electrical signals dependent on electrons incident on said electron detector;

an electrode system for accelerating said electrodes from said photocathode onto said electron detector; and a plurality of electron multipliers disposed between said photocathode and said electron detector for multiplying said electrons generated by said photocathode, said plurality of electron multipliers comprising a plurality of wire grids respectively having openings therein, with the openings of at least two of said wire grids being offset relative to one another.

16. A radiation converter as claimed in claim 15 further comprising a gas-proof housing containing said radiation absorber, said electron multiplier and said electron detector.

17. A radiation converter as claimed in claim 16 further comprising an ultraviolet light suppressing gas contained in said housing.

18. A radiation converter as claimed in claim 17 wherein said gas contains at least one constituent selected from the group consisting of argon, krypton, xenon, helium, neon, $CO_2$, $N_2$, hydrocarbon, Di-methyl-ether, methanol-vapor and ethanol vapor.

19. A radiation converter as claimed in claim 15 wherein said radiation absorber has a needle-shaped structure composed of Csl:Na.

20. A radiation converter as claimed in claim 15 wherein said electron multiplier comprises a plastic film with opposite sides and having apertures proceeding through said plastic film between said opposite sides, said opposite sides each being covered with a metallization.

21. A radiation converter as claimed in claim 20 wherein said plastic film is comprised of polyamide and wherein said metallization is copper.

22. A radiation converter as claimed in claim 15 further comprising an electrically conducting intermediate layer forming an electrode of said electrode system, and disposed between said radiation absorber and said photocathode.

23. A radiation converter as claimed in claim 22 wherein said intermediate layer is composed of material selected from the group consisting of gold and carbon.

24. A radiation converter as claimed in claim 15 wherein said electron detector is a 2D thin-film panel.

25. A radiation converter as claimed in claim 24 wherein said 2D thin-film panel has a thin film composed of material selected from the group consisting of a-Se, a-Si and poly-Si.

26. A radiation converter comprising:

a radiation absorber for generating light photon depending on an intensity of radiation incident on said radiation absorber;

a photocathode following said radiation absorber which generates electrons dependent on the light photons generated by said radiation absorber;

an electron detector formed by a 2D thin-film panel for generating electrical signals dependent on electrons incident on said electron detector;

an electrode system for accelerating said electrodes from said photocathode onto said electron detector; and an electron multiplier disposed between said photocathode and said electron detector which multiplies said electrons generated by said photocathode.

27. A radiation converter as claimed in claim 26 further comprising a gas-proof housing containing said radiation absorber, said electron multiplier and said electron detector.

28. A radiation converter as claimed in claim 27 further comprising an ultraviolet light suppressing gas contained in said housing.

29. A radiation converter as claimed in claim 28 wherein said gas contains at least one constituent selected from the group consisting of argon, krypton, xenon, helium, neon, $CO_2$, $N_2$, hydrocarbon, Di-methyl-ether, methanol-vapor and ethanol vapor.

30. A radiation converter as claimed in claim 26 wherein said radiation absorber has a needle-shaped structure composed of Csl:Na.

31. A radiation converter as claimed in claim 26 comprising a plurality of electron multipliers disposed between said photocathode and said electron detector for multiplying said electrons generated by said photocathode.

32. A radiation converter as claimed in claim 31 wherein said electron multipliers comprise a plurality of wire grids.

33. A radiation converter as claimed in claim 32 wherein said wire grids have openings therein, and wherein the openings of at least two of said wire grids are offset relative to one another.

34. A radiation converter as claimed in claim 26 wherein said electron multiplier comprises a plastic film with opposite sides and having apertures proceeding through said plastic film between said opposite sides, said opposite sides each being covered with a metallization.

35. A radiation converter as claimed in claim 34 wherein said plastic film is comprised of polyamide and wherein said metallization is copper.

36. A radiation converter as claimed in claim 26 further comprising an electrically conducting intermediate layer forming an electrode of said electrode system, and disposed between said radiation absorber and said photocathode.

37. A radiation converter as claimed in claim 36 wherein said intermediate layer is composed of material selected from the group consisting of gold and carbon.

38. A radiation converter as claimed in claim 26 wherein said 2D thin-film panel has a thin film composed of material selected from the group consisting of a-Se, a-Si and poly-Si.

* * * * *